US010718504B1

(12) United States Patent
Liang

(10) Patent No.: US 10,718,504 B1
(45) Date of Patent: Jul. 21, 2020

(54) LAMP HOLDER FOR LED STRING LIGHT

(71) Applicant: Nanning City Hong Cai Illuminations Technology Company Limited, Nanning (CN)

(72) Inventor: Faquan Liang, Nanning (CN)

(73) Assignee: Nanning City Hong Cai illuminations Technoloogy Company Limited, Nanning (CN)

( * ) Notice: Subject to any disclaimer, the term of this patent is extended or adjusted under 35 U.S.C. 154(b) by 0 days.

(21) Appl. No.: 16/685,039

(22) Filed: Nov. 15, 2019

(30) Foreign Application Priority Data

Nov. 4, 2019 (CN) ..... 2019 2 1883567 U

(51) Int. Cl.

| | |
|---|---|
| ***F21V 23/06*** | (2006.01) |
| ***F21S 4/10*** | (2016.01) |
| ***F21V 15/01*** | (2006.01) |
| ***H01R 33/09*** | (2006.01) |
| ***H01R 13/631*** | (2006.01) |
| ***F21V 19/00*** | (2006.01) |
| ***F21Y 115/10*** | (2016.01) |

(52) U.S. Cl.
CPC ..... *F21V 23/06* (2013.01); *F21S 4/10* (2016.01); *F21V 15/01* (2013.01); *F21V 19/002* (2013.01); *H01R 13/631* (2013.01); *H01R 33/09* (2013.01); *F21Y 2115/10* (2016.08)

(58) Field of Classification Search
CPC ..... H01R 33/09; H01R 13/631; F21V 19/002; F21V 15/01; F21V 23/06; F21S 4/10
See application file for complete search history.

(56) References Cited

U.S. PATENT DOCUMENTS

| | | | | |
|---|---|---|---|---|
| 6,066,004 | A * | 5/2000 | Shen | F21V 19/0015 439/611 |
| 7,893,627 | B2 * | 2/2011 | Li | F21V 19/0005 315/185 R |
| 2015/0211726 | A1 * | 7/2015 | Wu Lee | F21V 31/005 362/645 |
| 2017/0363273 | A1 * | 12/2017 | Chen | F21V 23/001 |

* cited by examiner

*Primary Examiner* — Thomas M Sember
(74) *Attorney, Agent, or Firm* — Wang Law Firm, Inc.

(57) ABSTRACT

A lamp holder for an LED string light includes a lamp housing, an LED lighting module, a plug, and a socket. An open end of the lamp housing is pre-sintered with an encapsulation layer. The LED lighting module is disposed in the lamp housing, and has a cathode pin and an anode pin extending out from the encapsulation layer. Because the LED lighting module is pre-encapsulated in the lamp housing, when installed, only the LED lighting module and the plug need to be assembled so as to complete the assembly of the lamp housing, the LED lighting module and the plug. This reduces the assembly steps for production.

4 Claims, 1 Drawing Sheet

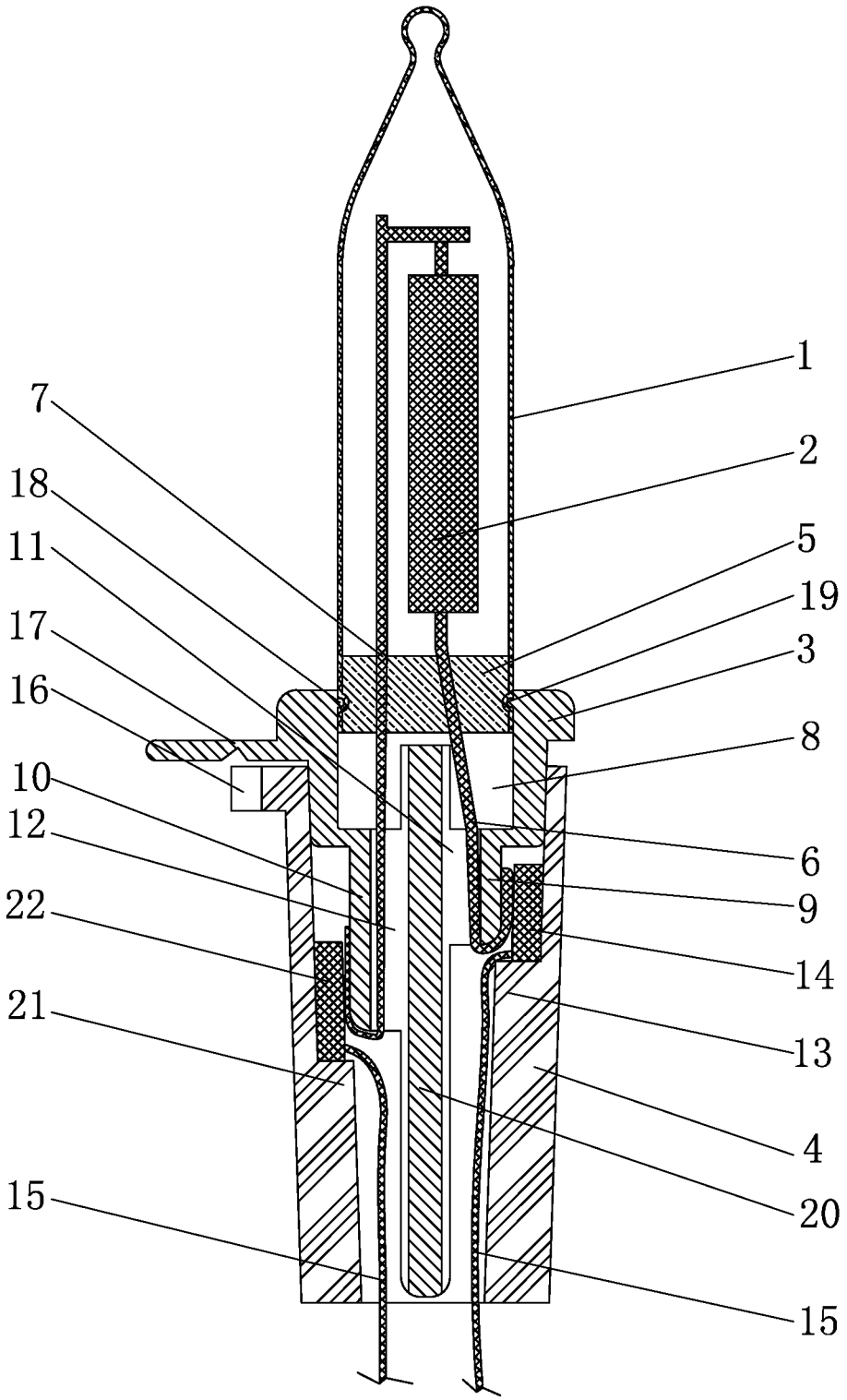
1
2
5
19
3
8
6
9
14
13
4
20
15
15
7
18
11
17
16
10
12
22
21

LAMP HOLDER FOR LED STRING LIGHT

FIELD OF THE INVENTION

The present invention relates to a lamp, and more particularly to a lamp holder for an LED string light.

BACKGROUND OF THE INVENTION

As to a conventional lamp holder for an LED string light, an LED lighting module and a lamp housing are respectively mounted on a plug, and then the plug is inserted into a socket to achieve the electrical connection between the LED lighting module and the socket.

In assembly, the assembly of the plug, the LED lighting module and the lamp housing requires two steps: one is to install the LED lighting module in the plug; the other is to insert the lamp housing in the plug. There is no direct connection between the LED lighting module and the lamp housing.

In order to improve the production efficiency, it is necessary to develop a novel lamp holder for an LED string light to reduce the assembly steps.

SUMMARY OF THE INVENTION

In view of the deficiencies of the prior art, the present invention provides a lamp holder for an LED string light.

In order to achieve the above object, the present invention provides the following technical solutions:

A lamp holder for an LED string light comprises a lamp housing, an LED lighting module, a plug, and a socket. An open end of the lamp housing is pre-sintered with an encapsulation layer. The LED lighting module is disposed in the lamp housing. The LED lighting module has a cathode pin and an anode pin extending out from the encapsulation layer. An upper portion of the plug is formed with a groove. Outer walls of two sides of a middle portion of the plug are respectively provided with an upper lug and a lower lug that have different lengths. The upper lug and the lower lug are respectively provided with a first through hole and a second through hole that are in communication with the groove. A free end of the cathode pin is inserted through the groove and the first through hole in sequence and then bent and attached to an outer wall of the upper lug. A free end of the anode pin is inserted through the groove and the second through hole in sequence and then bent and attached to an outer wall of the lower lug. The plug is inserted in the socket. An inner wall of the socket is provided with a first limiting rib and a second limiting rib to cooperate with the upper lug and the lower lug. An upper portion of the first limiting rib is provided with a first conductive plate to cooperate with the cathode pin. An upper portion of the second limiting rib is provided with a second conductive plate to cooperate with the anode pin. The first conductive plate and the second conductive plate are connected with two wires. The two wires extend out from a bottom of the socket.

Preferably, an outer wall of the socket is formed with an engaging groove. An outer wall of the plug is provided with an engaging buckle to cooperate with the engaging groove.

Preferably, an inner wall of the groove of the plug is provided with an annular flange, and an outer wall of the lamp housing is provided with an annular groove to cooperate with the annular flange.

Preferably, a partition is disposed in the plug to separate the cathode pin from the anode pin.

Compared with the prior art, the present invention has the following beneficial effects:

1. The LED lighting module is pre-encapsulated in the lamp housing by the supplier. In assembly, only the LED lighting module and the plug need to be assembled. This can reduce the production steps to improve production efficiency.

2. Since the cathode and anode pins of the LED lighting module are secured by the encapsulation layer, the pins of the LED lighting module are not easy to touch each other during transportation to result in a short circuit.

3. Since the LED lighting module becomes smaller and smaller, it is not easy to be clamped and easily damaged. The LED lighting module is pre-encapsulated in the lamp housing, which is not only easy to assemble, but also has a better protection effect.

4. The upper lug and the lower lug that have different lengths play a foolproof effect in the process of assembling the plug and the socket.

BRIEF DESCRIPTION OF THE DRAWINGS

FIG. 1 is a cross-sectional view of the present invention.

DESCRIPTION OF THE PREFERRED EMBODIMENTS

In view of the deficiencies of the prior art, the present invention provides a lamp holder for an LED string light.

As shown in FIG. 1, a lamp holder for an LED string light in accordance with an embodiment of the present invention comprises a lamp housing 1, an LED lighting module 2, a plug 3, and a socket 4.

An open end of the lamp housing 1 is pre-sintered with an encapsulation layer 5. The LED lighting module 2 is disposed in the lamp housing 1. The LED lighting module 2 has a cathode pin 6 and an anode pin 7 extending out from the encapsulation layer 5. It should be noted that the lamp housing 1 that is pre-installed with the LED lighting module 2 can be customized by the supplier.

An upper portion of the plug 3 is formed with a groove 8. In this embodiment, the open end of the lamp housing 1 is inserted into the groove 8. The outer walls of two sides of a middle portion of the plug 3 are respectively provided with an upper lug 9 and a lower lug 10 that have different lengths. The upper lug 9 and the lower lug 10 are respectively provided with a first through hole 11 and a second through hole 12 that are in communication with the groove 8. A free end of the cathode pin 6 is inserted through the groove 8 and the first through hole 11 in sequence, and then bent and attached to the outer wall of the upper lug 9. A free end of the anode pin 7 is inserted through the groove 8 and the second through hole 12 in sequence, and then bent and attached to the outer wall of the lower lug 10. The plug 3 is inserted in the socket 4. The inner wall of the socket 4 is provided with a first limiting rib 13 and a second limiting rib 21 to cooperate with the upper lug 9 and the lower lug 10. An upper portion of the first limiting rib 13 is provided with a first conductive plate 14 to cooperate with the cathode pin 6. An upper portion of the second limiting rib 21 is provided with a second conductive plate 22 to cooperate with the anode pin 6. The first conductive plate 14 and the second conductive plate 22 are connected with two wires 15. The two wires 15 extend out from the bottom of the socket 4.

Furthermore, the outer wall of the socket 4 is formed with an engaging groove 16. The outer wall of the plug 3 is provided with an engaging buckle 17 to cooperate with the engaging groove 16. Specifically, the underside of a middle portion of the engaging buckle 17 is formed with a notch. The engaging buckle 17 is bent along the notch to be engaged with the engaging groove 16, so that the engagement of the plug 3 with the socket 4 is more secure.

Furthermore, the inner wall of the groove 8 of the plug 3 is provided with an annular flange 18. The outer wall of the lamp housing 1 is provided with an annular groove 19 to cooperate with the annular flange 18, so that the lamp housing 1 can be secured firmly.

Furthermore, a partition 20 is disposed in the plug 3 to separate the cathode pin 6 from the anode pin 7, thereby preventing the cathode and anode pins of the LED lighting module 2 from touching each other to cause a short circuit.

When the invention is assembled, the lamp housing 1 is held, the cathode pin 6 and the anode pin 7 of the LED lighting module 2 are respectively inserted through the first through hole 11 and the second through hole 12 and then bent to complete the assembly of the lamp housing 1, the LED lighting module 2 and the plug 3, thereby reducing the assembly steps in industrial production, improving the production efficiency greatly, and being more suitable for industrial production. Due to the cooperation of the upper lug 9, the lower lug 10, the first limiting rib 13 and the second limiting rib 21, a better foolproof effect is achieved. The present invention can prevent the operator from connecting the cathode and anode pins of the LED lighting module 2 wrongly after working for a long time and can improve the yield of the production.

In summary, the invention solves the deficiencies existing in the prior art through the above structural design, and has the characteristics of reasonable structural design and good use effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lamp holder for an LED string light, comprising a lamp housing, an LED lighting module, a plug, and a socket;

an open end of the lamp housing being pre-sintered with an encapsulation layer; the LED lighting module being disposed in the lamp housing, the LED lighting module having a cathode pin and an anode pin extending out from the encapsulation layer;

an upper portion of the plug being formed with a groove, outer walls of two sides of a middle portion of the plug being respectively provided with an upper lug and a lower lug that have different lengths; the upper lug and the lower lug being respectively provided with a first through hole and a second through hole that are in communication with the groove; a free end of the cathode pin being inserted through the groove and the first through hole in sequence and then bent and attached to an outer wall of the upper lug; a free end of the anode pin being inserted through the groove and the second through hole in sequence and then bent and attached to an outer wall of the lower lug;

the plug being inserted in the socket, an inner wall of the socket being provided with a first limiting rib and a second limiting rib to cooperate with the upper lug and the lower lug; an upper portion of the first limiting rib being provided with a first conductive plate to cooperate with the cathode pin, an upper portion of the second limiting rib being provided with a second conductive plate to cooperate with the anode pin; the first conductive plate and the second conductive plate being connected with two wires, the two wires extending out from a bottom of the socket.

2. The lamp holder as claimed in claim 1, wherein an outer wall of the socket is formed with an engaging groove; an outer wall of the plug is provided with an engaging buckle to cooperate with the engaging groove.

3. The lamp holder as claimed in claim 1, wherein an inner wall of the groove of the plug is provided with an annular flange, and an outer wall of the lamp housing is provided with an annular groove to cooperate with the annular flange.

4. The lamp holder as claimed in claim 1, wherein a partition is disposed in the plug to separate the cathode pin from the anode pin.

* * * * *